US008770412B2

(12) United States Patent
Miller

(10) Patent No.: US 8,770,412 B2
(45) Date of Patent: Jul. 8, 2014

(54) GRAVIMETRIC MINERAL PROCESSING DEVICE AND METHOD FOR ITS USE

(71) Applicant: Gerald Lee Miller, Prince Geroge (CA)

(72) Inventor: Gerald Lee Miller, Prince Geroge (CA)

( * ) Notice: Subject to any disclaimer, the term of this patent is extended or adjusted under 35 U.S.C. 154(b) by 0 days.

(21) Appl. No.: 13/708,193

(22) Filed: Dec. 7, 2012

(65) Prior Publication Data

US 2014/0158587 A1 Jun. 12, 2014

(51) Int. Cl.

| | |
|---|---|
| ***B03B 5/00*** | (2006.01) |
| ***B07B 1/34*** | (2006.01) |
| ***B07B 1/28*** | (2006.01) |

(52) U.S. Cl.

USPC ..... 209/445; 209/437; 209/325; 209/322; 209/310

(58) Field of Classification Search

USPC ..... 209/310, 320, 322, 323, 325, 437, 445, 209/446, 461, 466–469

See application file for complete search history.

(56) References Cited

U.S. PATENT DOCUMENTS

| | | | | | |
|---|---|---|---|---|---|
| 146,168 | A | | 1/1874 | Collom | |
| 146,275 | A | | 1/1874 | Paul | |
| 234,826 | A | | 11/1880 | Waugaman | |
| 687,793 | A | | 7/1901 | Look | |
| 763,787 | A | | 6/1904 | Overstrom | |
| 801,968 | A | | 10/1905 | Clark | |
| 808,023 | A | | 12/1905 | Gardner | |
| 984,866 | A | * | 2/1911 | Tate | 209/467 |
| 1,015,823 | A | * | 1/1912 | Muender | 209/467 |
| 1,039,132 | A | * | 9/1912 | Hughes | 209/694 |
| 1,048,171 | A | | 12/1912 | Hughes | |
| 1,265,267 | A | * | 5/1918 | Simpson | 209/332 |
| 1,505,735 | A | * | 8/1924 | Stebbins | 209/467 |
| 1,505,738 | A | * | 8/1924 | Stebbins | 209/504 |
| 1,588,102 | A | | 6/1926 | Goody | |
| 1,833,447 | A | * | 11/1931 | Taylor | 209/467 |
| 1,915,602 | A | | 6/1933 | Goody | |
| 1,961,666 | A | | 6/1934 | Hoyois | |
| 2,256,504 | A | | 9/1941 | Stewart | |
| 2,353,492 | A | * | 7/1944 | O'Connor | 366/112 |
| 2,427,423 | A | * | 9/1947 | Shawcross | 209/467 |
| 2,592,605 | A | | 4/1952 | Searles | |
| 3,325,007 | A | * | 6/1967 | Erlenstadt et al. | 209/315 |
| 3,454,162 | A | * | 7/1969 | Cover | 209/269 |
| 3,682,304 | A | * | 8/1972 | Seidel | 209/443 |
| 3,807,554 | A | * | 4/1974 | Satake | 209/694 |
| 4,078,996 | A | * | 3/1978 | Cohen-Alloro et al. | 209/441 |
| 4,150,749 | A | * | 4/1979 | Stevens | 209/437 |
| 4,170,549 | A | | 10/1979 | Johnson | |
| 4,251,357 | A | * | 2/1981 | Wright | 209/437 |
| 4,279,740 | A | * | 7/1981 | Isogaya | 209/12.2 |

(Continued)

FOREIGN PATENT DOCUMENTS

| | | |
|---|---|---|
| GB | 09153 | 5/1916 |

*Primary Examiner* — Patrick Cicchino
(74) *Attorney, Agent, or Firm* — Denis R. O'Brien

(57) ABSTRACT

The invention disclosed and claimed herein is a device for processing minerals and a method for its use, which device and method employ gravimetric principles to separate values in a feedstock from gangue, thereby allowing recovery or concentration of the values. The invention includes a table that receives and holds the feedstock, a chassis for supporting the table, and a mechanism for imparting a specific motion to the table, the motion being referred to as "compound cyclic," which is a reciprocating, rectilinear, to-and-fro motion parallel to or coincident with the working axis of the table, combined with a simultaneous, continuous, and smooth vertical up-and-down motion that eliminates vertical jolting, jarring, or bumping.

18 Claims, 4 Drawing Sheets

(56) References Cited

U.S. PATENT DOCUMENTS

| | | | | | |
|---|---|---|---|---|---|
| 4,316,799 | A | * | 2/1982 | Satake | 209/504 |
| 4,371,435 | A | | 2/1983 | Eckersley | |
| 4,521,302 | A | * | 6/1985 | Stone | 209/441 |
| 4,523,989 | A | | 6/1985 | Graefe | |
| 4,583,645 | A | * | 4/1986 | Yamamoto | 209/694 |
| 4,715,949 | A | | 12/1987 | Watts | |
| 4,758,334 | A | * | 7/1988 | Rodgers | 209/441 |
| 4,861,463 | A | * | 8/1989 | Slesarenko | 209/315 |
| 5,148,921 | A | * | 9/1992 | White | 209/20 |
| 5,421,461 | A | | 6/1995 | Ruzic | |
| 5,617,955 | A | * | 4/1997 | Tanner | 209/458 |
| 2006/0243643 | A1 | | 11/2006 | Scott | |
| 2007/0170099 | A1 | | 7/2007 | Stolworthy | |

* cited by examiner

GRAVIMETRIC MINERAL PROCESSING DEVICE AND METHOD FOR ITS USE

CROSS-REFERENCE TO RELATED APPLICATION

Not applicable.

BACKGROUND

The field of my invention is mineral processing, and more particularly gravimetric separation devices and methods for separating, concentrating, or recovering mineral values from a feedstock.

The term "values" is used herein to mean the target mineral or minerals that one who is employing my invention wishes to recover or concentrate. The term "gangue" is used herein in its standard mineralogical context to mean the contaminants or non-value components of a feedstock; i.e., the unwanted material in the feedstock from which the values are being separated. The term "feedstock" is used herein to mean a raw mixture or conglomeration made up of values admixed with gangue. Within the context of the present disclosure, a feedstock includes such a mixture that has been screened or otherwise sized. "Fluidized feedstock" and "feedstock slurry" refer to a feedstock suspended in a sufficient volume of processing-fluid, normally water, to facilitate gravimetric separation of values from gangue. Although the present disclosure focuses on gold recovery, my invention and the principles, devices, and processes discussed herein are more generally applicable to all situations were differences in the densities in ores, minerals, and other materials are exploited in order to separate values from gangue.

In the field of mineral processing it has long been known that differences in the densities of minerals and materials can be exploited to separate values from gangue. Gravimetric principles are the basis of many mineral processing techniques, from the primitive gold panning technique to more sophisticated and mechanized techniques such as vibrating or percussion tables, often implemented as "wet tables" that process fluidized feedstock.

The best known approach to wet vibrating tables is the so-called Wilfley table, which is an essentially planar, tilted surface with a plurality of ribs or riffles protruding from the surface. The feedstock is added as a slurry at the high end of the tilted surface and is washed across the surface while a vibrational motion is applied to the table in the plane of the table and orthogonal to the direction of the flow of water. A number of variations of this basic approach have been patented, including differing table shapes and dimensions, different riffle patterns and sizes, different mechanisms for vibrating the table. See, for instance, U.S. Pat. No. 4,758,334 to Rodgers, U.S. Pat. No. 4,078,996 to Cohen-Allror and Cuviller, and U.S. Pat. No. 4,150,749 to Stevens.

Whilst the vibrating table approach has been very useful, improvements in this approach have generally not focused on maximizing the type of motion that is imparted to the feedstock slurry. The motion that has been almost universally used is a vibration, which is to say a to-and-fro lateral motion applied within the plane of the table. An exception to this general simple lateral vibration approach is the 1915 Great Britian patent 9153 to Ogle et al. in which a sudden downward jolt or "vertical bump" is applied to the table.

I have made the discovery that the separation of values from gangue is greatly enhanced by subjecting a washed feedstock or feedstock slurry to a compound cyclic motion, as that motion is defined below. Furthermore, the separation can be enhanced even more by applying the compound cyclic motion to a vee-table that is tilted at an optimum angle, as disclosed herein.

The following definitions are employed throughout this disclosure and the claims.

"Table" is used herein to mean a surface or receptacle element of the invention that receives feedstock for processing. The term includes analogous terms used in the art, by way of example: "pan," "jig pan," "trough," "buddle," "deck," "board," and "riffle board." A table may have any shape and dimensions that can be employed by my invention. The term "vee-table" refers to an elongate table having sides that converge at the bottom to form a valley that is parallel with the working axis of the table.

"Horizontal" and "vertical" have their common meanings and are used to denote orientation or movement with respect to the ground. The "working axis" of the table refers to the axis of the table parallel to the direction the values and/or gangue migrate when the invention is in operation, which will be along the long axis of elongate tables. "Rectilinear" means along or in the direction of the working axis. "Orthogonal" refers to the direction or orientation that is horizontal and perpendicular to the working axis.

The "tilt-angle" is the angle between horizontal and the working axis. When the two axes are parallel, the tilt-angle is 0 degrees. "Tilt-means" refers to mechanisms disclosed herein and their equivalents that produce a tilt-angle with an absolute value greater than 0 degrees.

"Compound cyclic motion" is defined herein as a motion that combines a reciprocating, rectilinear, to-and-fro motion that is parallel to or coincident with the working axis with a simultaneous, continuous, smooth, vertical up-and-down motion. By "smooth" is meant that there are no sudden vertical movements such as jolts, jarring, or bumps, which tend to stir and re-mix the values and gangue as they separate.

"Table-drive means" refers to mechanisms disclosed herein and their equivalents that impart a compound cyclic motion to a table.

SUMMARY OF THE INVENTION

The invention disclosed and claimed herein is a device for processing minerals and a method for its use, which device and method employ gravimetric principles to separate values in a feedstock from gangue, thereby allowing recovery or concentration of the values. The disclosure provided here is made with respect to processing gold ore feedstock to recover gold values; however, my invention is generally applicable to any mineral processing where the density of the values is different from the density of the gangue.

My invention includes a table that receives and holds the feedstock, a chassis for supporting the table, and a mechanism for imparting a specific motion to the table, the motion being referred to as "compound cyclic," which is a reciprocating, rectilinear, to-and-fro motion parallel to or coincident with the working axis of the table, combined with a simultaneous, continuous, and smooth vertical up-and-down motion that eliminates vertical jolting, jarring, or bumping.

One embodiment of my invention includes a vee-table in combination with structures for producing compound cyclic motion, whereby the compound cyclic motion is imparted to the vee-table. This combination has unexpected benefits. For instance, the combination obviates orthogonal drifting of values even when the table has not been leveled along the orthogonal axis.

One embodiment of my invention includes a tilt-means in combination with structures for producing compound cyclic motion. The tilt means causes the working axis of the table to deviate from horizontal. When such a tilted table is moved in the compound cyclic motion, the separation of values from gangue is further enhanced.

One embodiment of my invention includes means for making on-the-fly adjustments to operating parameters such as tilt-angle and operating speed.

These and other features and benefits of my invention will be readily appreciated in view of the Detailed Description below. It should be noted that the drawings taken in conjunction with the description illustrate preferred embodiments of my invention and the various features of those embodiments. These embodiments represent the best mode known to me for practicing my invention in its various aspects and are not intended to be limiting with respect to the scope of the invention. The figures are not necessarily drawn to scale. Where the same element is shown in more than one figure, the same reference numeral is used.

DETAILED DESCRIPTION OF THE INVENTION

A. Structures of Preferred Embodiments

Figure 1:
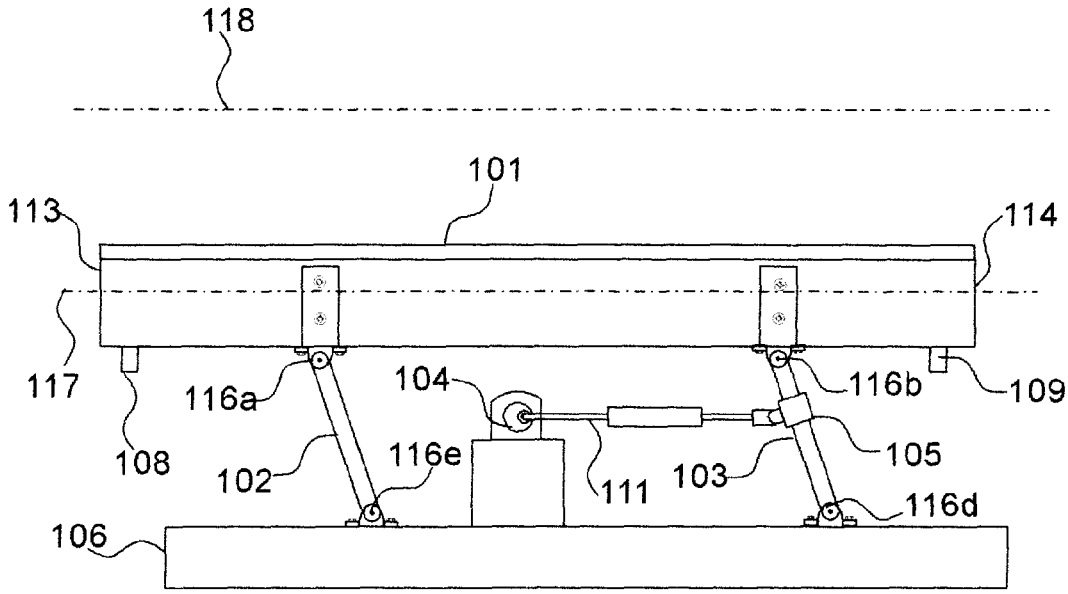
FIG. 1 is a side view of one preferred embodiment of the device of my invention.
Figure 2:
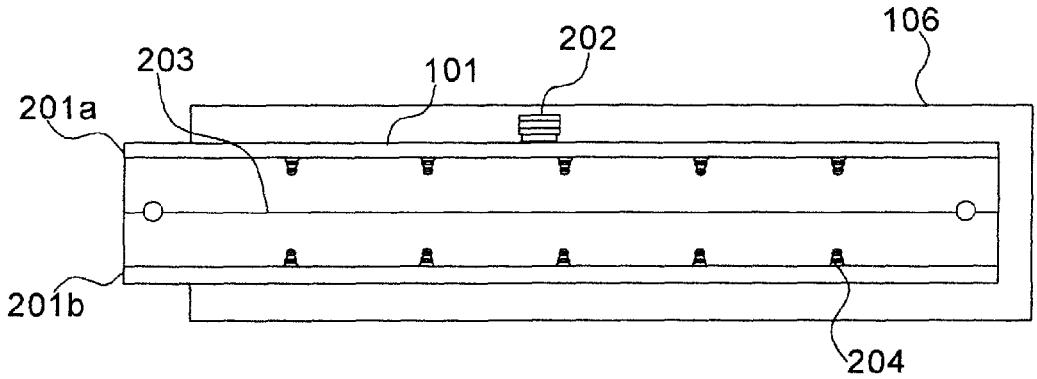
FIG. 2 is a top view of the device of FIG. 1.

FIG. 1 and FIG. 2 illustrate a basic embodiment of my invention, comprising a table 101 supported by a chassis 106. To help keep the reader oriented throughout this disclosure, the working axis 117 of the table and a horizontal axis 118 are indicated. While the table may take any shape consistent with the objectives of the invention, the preferred table is vee-shaped in cross-section (see below) with the sides converging at their lower edges to form a valley 203 parallel with the working axis. Such a table is referred to herein as a "vee-table."

Optionally, the table has connected thereto or otherwise incorporates a values outlet 109 and/or a gangue outlet 108, as further explained below. For purposes of description, the end of the table closest to the values outlet is referred to herein as the "values-end" 114, and the opposite end of the table, closest to the gangue outlet, is referred to herein as the "gangue-end" 113. Thus, the values-end and the ganguge end refer to opposing ends of the table and of the device as a whole. It is also convenient to refer to the values-end as "aft," and the gangue-end as "fore," although the table has no inherent directionality because the device as a whole maintains a fixed position while in operation.

Table 101 is coupled to chassis 106 by means a table-drive means, which is provided for imparting a compound cyclic motion to fluidized feedstock held by the table. In the present embodiment, the table-drive means includes a drive-motor 202, an eccentric-coupler 104, a set of aft reciprocating legs 103, a set of fore reciprocating legs 102 and a linkage-assembly that directly or indirectly couples the eccentric-coupler to the table.

The reciprocating legs include joints **116*a*-116*e* at the tops and bottoms of the legs. These joints allow the table to move in a compound cyclic motion, as disclosed in detail below. In the present embodiment the table-drive means is indirectly coupled to the table through at least one of the reciprocating legs, which is referred to herein as a "drive-leg." A drive-leg is a leg that is coupled to the drive-motor by the linkage-assembly. In the figures, the drive-legs are the aft reciprocating legs 103**; however, any leg or set of legs could serve as a drive-leg.

The linkage-assembly comprises a linkage-rod 111 and a leg-coupler 105. Preferably the leg coupler is a sliding-coupler as shown in the figures. A sliding-coupler is an adjustable leg-coupler configured to adjustably slide up and down the drive-leg and can be fixed at a desired position along the leg.

One end of the linkage-rod 111 is coupled to the leg-coupler. 105 The other end of the linkage-rod is coupled to the eccentric-coupler. 104 Optionally, the length of the linkage-rod is adjustable. By adjusting this length and the position of the sliding-coupler on the drive leg, the stroke of drive-means can be adjusted. This stroke is referred to herein as "drive-stroke." The drive-stroke is the maximum lateral displacement of the table in one direction during one rotation of the eccentric-coupler for a given adjustment of the linkage-rod and leg-coupler.

The eccentric-coupler is connected to and rotated by the motor 202, which can be, for instance, electric, hydraulic, or internal combustion. My preference is a 1.5 horsepower electric motor. The angular velocity of the eccentric-coupler may be controlled by altering the speed of the motor through a variable speed control, which can be of any convenient type.

As discussed in detail below, it is most advantageous in the operation of my invention to have the working-axis 117 of the table 101 tilted with respect to horizontal axis 118, which is to say, for instance, the values-end 114 of the table raised with respect to the gangue-end 113. One way to accomplish this tilting is to tilt the base or platform upon which chassis 106 is mounted. Another, and preferred, way is to provide a tilt-means which may comprise a tilt-frame, a lift-mechanism, and a tilt-hinge, as shown in FIGS. 3 and 4 and disclosed in the next paragraphs.

Figure 3:
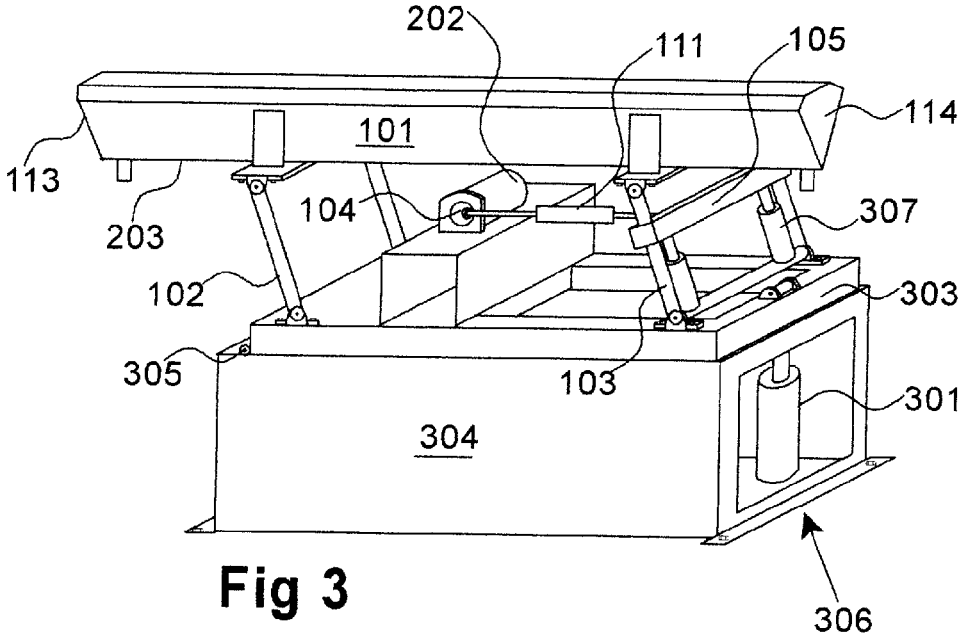
FIG. 3 is a perspective view of a preferred embodiment of the device of my invention, including a base and showing details of a preferred tilt-means and stroke-adjustment means.
Figure 4:
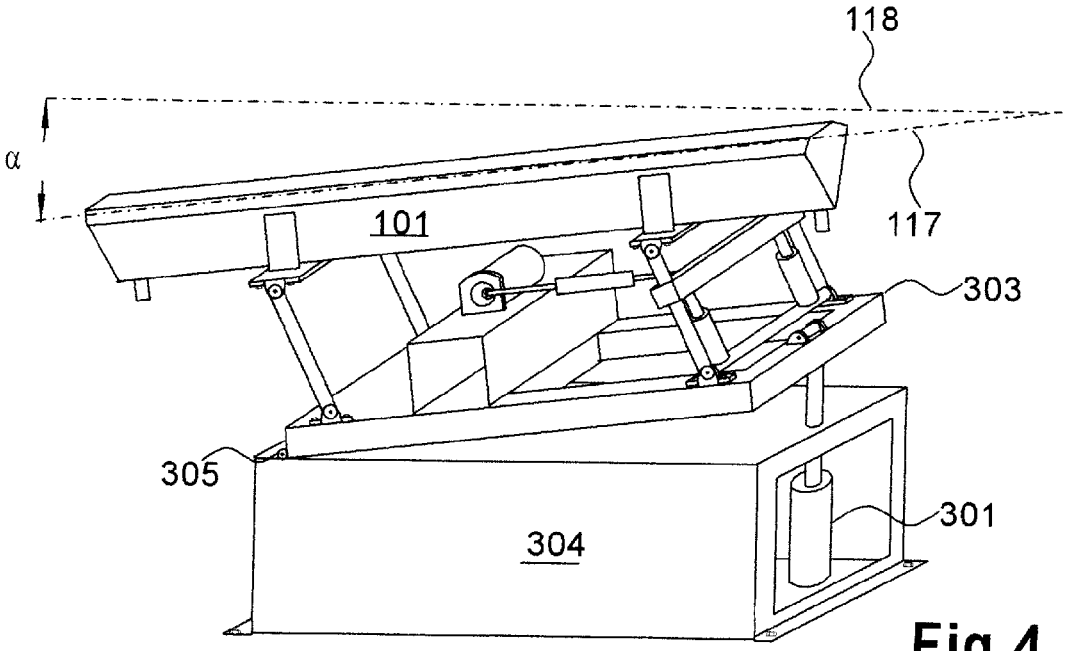
FIG. 4 is the same view and subject matter as FIG. 3 showing the chassis and table in a tilted position.

Elements in FIGS. 3 and 4 that are also shown in FIGS. 1 and 2 are given the same reference numerals. The primary structural difference between the embodiment of FIG. 1 and the embodiment of FIGS. 3/4 is that the chassis 106 of FIG. 1 is static, whilst in FIG. 3 the chassis includes a tilt-frame 303 mounted on a base 304. There is also provided a lift-mechanism 306 that lifts one end of the table 101, by tilting the tilt-frame. A preferred lift-mechanism is a hydraulic system comprising a hydraulic cylinder/piston 301 mounted on the base 304 below the values-end 114 of the table 101 and the tilt-frame, with the piston coupled to the tilt-frame so that the values-end of the chassis is raised and lowered by the extension and retraction of the piston. The tilt-means further includes a tilt-hinge 305 at the gangue-end 113 of the tilt-frame. The tilt-hinge connects the tilt-frame 303 to the base 304 so that the tilt-frame may be tilted about the hinge.

As shown in FIG. 4, by extending and retracting the tilt piston, the tilt-frame is rotated about the tilt-hinge, thereby raising and lowering the values-end 114 with respect to the gangue-end 113 and imparting a desired tilt-angle on the table

101. The tilt-angle is designated "α" in FIG. 4 and is defined as the angle between the horizontal axis 118 and the working-axis 117.

FIGS. 1 and 3 show details of the table-drive means, including drive-motor 202, eccentric-coupler 104, linkage-rod 111, and leg-coupler 105, which is of the sliding-coupler type. The aft end of the linkage-rod 111 is connected to the leg-coupler 105. As noted above, the sliding-coupler is slidably attached to the drive leg, which is aft reciprocating leg 103, such that the sliding-coupler is caused to slide up and down the length of the drive-leg under force applied by a stroke-adjustment means.

My preferred embodiment of the stroke-adjustment means is shown in FIGS. 3 and 4 and comprises at least one hydraulic stroke-adjustment cylinder/piston assembly 307 coupled to the sliding-coupler. Specifically, the upper end of the piston of the stroke-adjustment cylinder/piston 301 is coupled to the sliding-coupler so that the sliding-coupler is moved up and down along the aft legs by the extension and retraction of the stroke-adjustment piston.

FIGS. 3 and 4 also illustrate what is meant by the table 101 being a vee-table, as the sides of the table are shown converging to form the valley 203.

Figure 5:
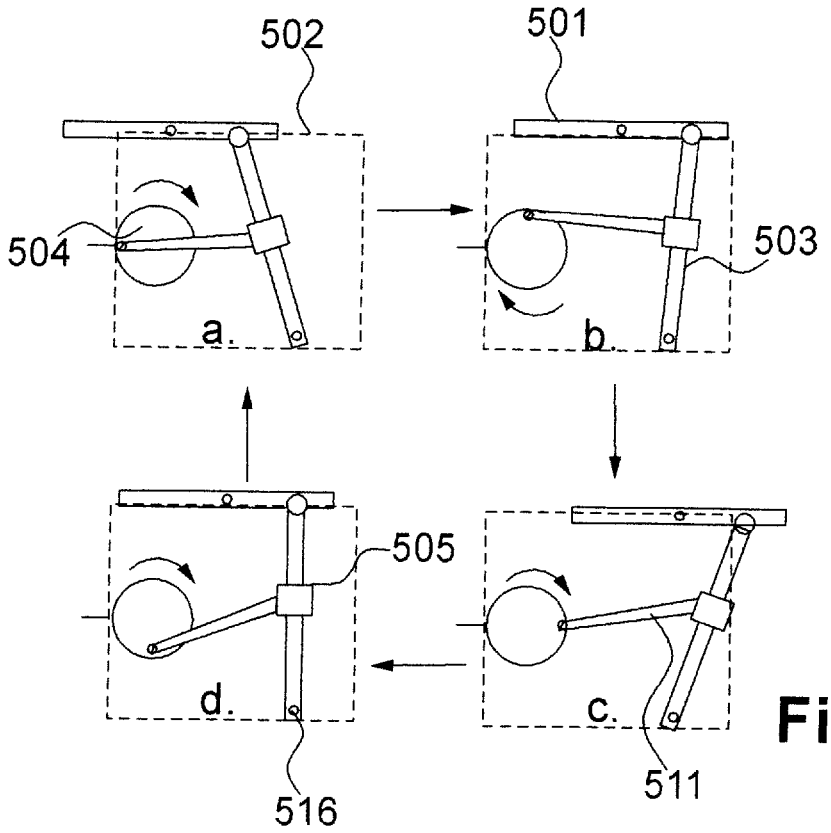
FIG. 5 is a schematic showing the relative motions of certain moving elements of the table during one cycle.
Figure 6:
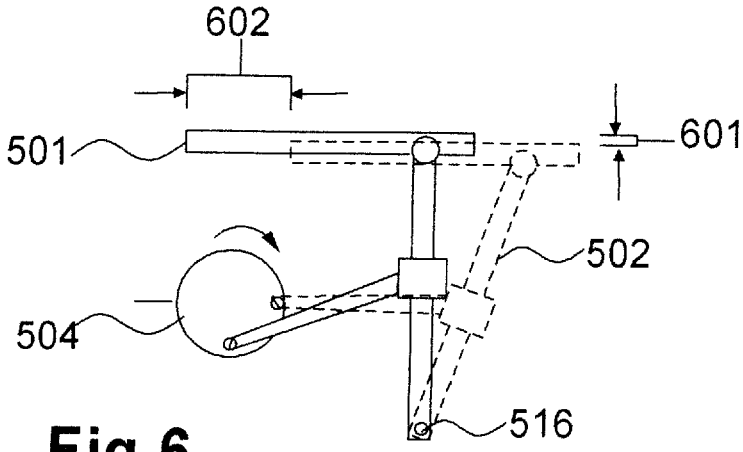
FIG. 6 is a schematic showing how the compound cyclic motion is produced by the table-drive device, and indicating horizontal and vertical displacements of the table during one-half of a cycle.

FIGS. 5 and 6 illustrate how the table-drive means imparts a compound cyclic motion to the feedstock. The elements are shown in simplified form for ease of comprehension. Each of the reference numerals refers to the respective element in all four drawings of FIG. 5 and in FIG. 6, as follows: 501 represents a table; 503 represents a drive-leg, 505 represents a sliding-coupler, which is fixed in position on the drive-leg; 511 represents a drive-linkage; and, 504 represents an eccentric-coupler. The drive cycle proceeds from step a. to step b. to step c. to step d. A reference frame 502 is provided to help follow the relative positions of the moving elements throughout the cycle.

A motor (not shown) causes the eccentric-coupler 504 to rotate, for example, in a clockwise direction as indicated in the figure. The fore end of the drive linkage 511 is eccentrically coupled to the eccentric-coupler 504, whereas the aft end of the drive linkage is coupled to the sliding-coupler 505. The sliding-coupler, which is mounted on the drive-leg 503 and can slide up and down the length of the leg, is fixed at a desired position on the leg.

The rotating eccentric-coupler 504 thus drives the drive-leg 503 to-and-fro about its bottom joint 516. This imparts the compound cyclic motion to the top of the leg 503, and, hence, to the table 501 and the feedstock held by the table. The compound motion is comprised of a reciprocating, rectilinear, to-and-fro motion parallel to or coincident with the working axis combined with a simultaneous, continuous, smooth, vertical up-and-down motion. The use of the rotating eccentric-coupler to produce the motion obviates vertical jarring and bumping.

FIG. 6 shows cycle steps 5.*b.* and 5.*c.* isolated and superimposed in order to demonstrate the vertical displacement 601 and lateral displacement 602 of the table that occurs in one-half of a cycle. Given that only one-half of a cycle is represented in FIG. 6, the drive-stroke is twice the lateral displacement 602 shown. Of course, the compound cyclic motion that is imparted to the table is transmitted to the fluidized feedstock in the table. This gentle rotary motion greatly promotes the gravimetric separation of the values from the gangue. By eliminating vertical jarring and bumps that are a problem with prior art devices, this compound cyclic motion mitigates or completely obviates the tendency of the values and the gangue to re-mix as they are moving apart.

Referring back again to FIG. 2, a fluidizing means for delivering processing-fluid to the table 101 for fluidizing the feedstock held by or in the table. Processing-fluid, normally water in the case of gold processing, is defined herein as a fluid that is used to fluidize the feedstock so that differential gravimetric forces can more readily separate values from gangue. In addition to providing a medium for the separation to take place in, a moving processing-fluid also carries the gangue out of the feedstock and away from the values while facilitating the "walking" of the values toward the values end of the table.

My preferred fluidizing means is a dual manifold 201*a*/201*b* that receives processing-fluid from a fluid source (not shown) and distributes the fluid along both sides of the table through a plurality of manifold-nozzles 204. The processing-fluid exits the table through the values outlet and/or gangue outlet, depending whether and in what direction the table is tilted. A number of equivalent structures for fluidizing feedstock are well known in the field. For instance, a single manifold; a point source nozzle; and various spray apparatuses are effective ways to deliver processing-fluid to the table and fluidize the feedstock. One's choice of fluidizing means will often be dictated by the circumstances in which the mineral processing takes place, for instance the availability of power to power pumps, availability of gravity fed water, & etc. Another equivalent fluidizing means is a receptacle to hold the feedstock while processing-fluid is added to produce a slurry, which slurry is then introduced to the table.

In addition to housing the stroke-adjustment means, base 304 is also convenient for housing the hydraulics motors/pumps and the hydraulics fluid for powering the tilt-means and the stroke-adjustment means. The base can also house pumps and motors for pumping processing-fluid to the fluidizing means.

B. Method of Using My Invention

Figure 7:
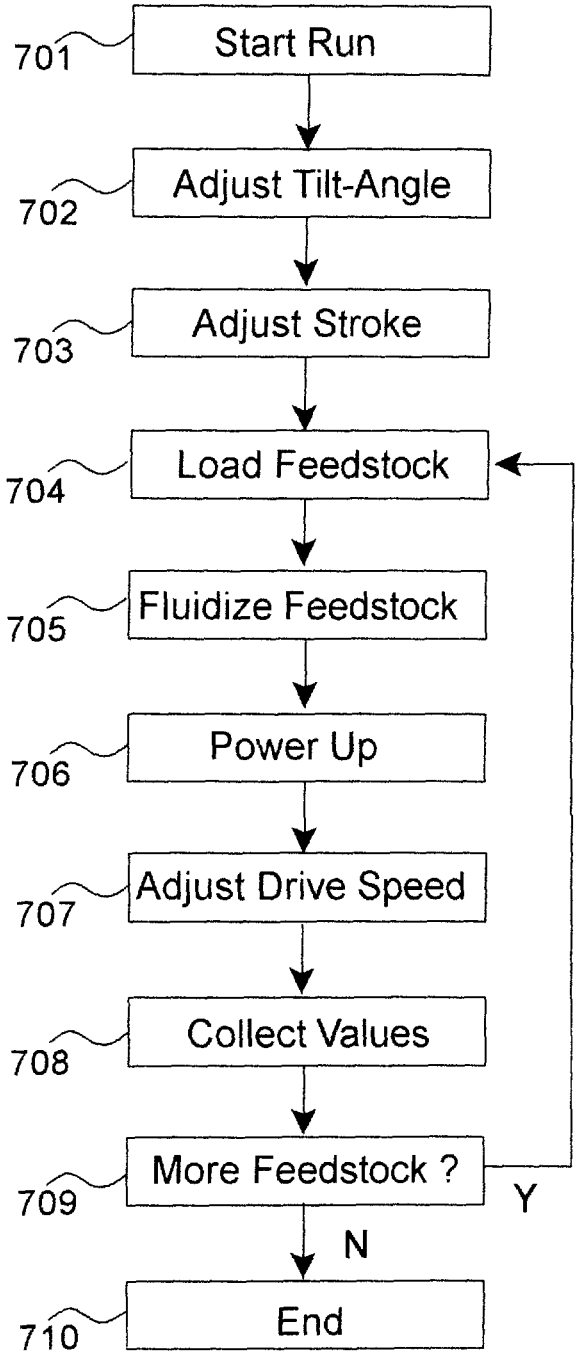
FIG. 7 is a flow chart showing the steps of a basic preferred embodiment of the method of the invention.

FIG. 7 summarizes in a simplified flow-chart of one preferred method of using my invention. FIG. 7 should be viewed in conjunction with FIGS. 1-4.

It is to be noted that not all of these steps are necessary, and the sequence of the steps may be modified in order to achieve the best results in different circumstances. The precise steps of the best mode of operation and their sequence will be determined by the type of values being processed, the working conditions, and the preferences of the operator.

The method is started 701 by preparing the device and the feedstock, connecting all of the hydraulic components, connecting sources of processing-fluid to the manifold 201*a/b,* and connecting electrical power to the drive-motor 202. Optionally, the tilt-angle is adjusted 702 by actuating the tilt-means 306. I find that when using a six-foot long vee-table, extending the hydraulic piston of the tilt means approximately six inches provides a suitable tilt-angle for separating gold values from a 10 mesh concentrate feedstock.

Optionally, the drive-stroke is adjusted 703 by sliding the sliding-coupler up or down on the drive-leg, which, in the case of FIG. 3, is reciprocating aft leg 103. The farther down the drive-leg the sliding-coupler is positioned, the longer the drive-stroke and the more robust the compound cyclic motion will be. The length of linkage-rod 111 is increased or decreased as necessary in order to position the sliding-coupler at the desired position.

The feedstock is then loaded 704 into the table 101. When separating gold values from a 10 mesh concentrate feedstock for instance, I prefer to load the feedstock about ⅓ of the way along the length of the table from the gangue end 117. That is, for a six foot table, the feedstock would be loaded about 2 feet from the gangue end. The amount of feedstock processed in a single run varies according to the size and nature of the table, the mesh of the feedstock, and the type of values being recovered. When processing 10 mesh concentrate with a six-foot vee-table to recover gold values, I add on the order of five pounds of the concentrate to the table. With this procedure, it is possible to process on the order of 100 pounds of concentrate an hour. Of course, hoppers and automatic feedstock loading devices that are well known in the field of mineral processing can be employed.

The feedstock is fluidized 705. This can be done in any way that is most expedient. The feedstock can, for instance, be loaded into the table as a slurry. However, I prefer to continuously supply processing-fluid through the dual manifold 201*a/b* and onto the length of the table through the nozzles 204, as disclosed above. This keeps the feedstock sufficiently suspended and fluidized throughout the processing.

At this point power is supplied 706 to drive-motor 202 of the table-drive means and the gravimetric separation process begins. It may be necessary to adjust the drive speed of the table-drive means 707 by a variable speed control of the drive-motor to achieve an optimum operating speed. The drive speed may be most conveniently measured as the rotational rate or angular velocity of the eccentric-coupler. I find that 200-350 rpm is adequate for separating gold values from 10 mesh concentrate.

As the drive-means imparts the compound cyclic motion to the table 101, and hence to the feedstock in the table, the gravimetric separation takes place. The gold values "walk" toward the values end 114 to the values outlet 109 and fall into the outlet to be collected 708 into a suitable receptacle. If the table has been tilted at step 702, gold values will walk "up" the table along the working axis. Simultaneously, the flowing processing-fluid washes the gangue toward the gangue end 113 of the table where it is washed into the ganguge outlet 108 and collected for further processing or to be disposed of. Once a quantum of feedstock has been processed, if there is more ready for processing 709, it is loaded 704, and the steps repeat. If there is no more feedstock ready for processing, the run ends. 710

I have found that with my device, using a vee-table as described above, it is possible to obtain at least a 95% recovery of gold values from standard 10 mesh concentrate feedstock. The device is capable of separating gold values from as small as at least 200 mesh particles to as large as at least 3 mm nuggets.

C. Embellishments, Variations, and Details

Table

There are two basic and essential functional requirements of a table to be used with my invention: 1) the table receives and holds the feedstock, and 2) the table must allow the compound cyclic motion produced by the drive-means to be imparted to the feedstock. Any shape or type of table that complies with these minimal requirements may be suitable. For instance, a Wilfey table or a table with ribs or riffles may be adapted to this end.

As noted above, the preferred embodiment of the invention employs a vee-table. I prefer an elongate table approximately 72 inches (183 cm) long, 12 inches (30.5 cm) wide at it's widest point near the top, and 9 inches (22.9 cm) in height from the bottom of the vee to the top of the trough. The sides converge at the bottom of the table to form a valley, such as shown in FIGS. 2 and 3. I prefer a smooth table surface.

One important advantage of combining the vee-table with the tilt-means is that it is not necessary to carefully level the device in prior to operation. Often mineral processing takes place in circumstances and surroundings that make leveling a table difficult or impossible. With the tilt-means of the present invention any deviations from horizontal of the ground along the long axis of the table can be compensated for by adjusting the tilt-angle of the table. The problem of values "straying" sideways on the table due to the table not being level along the orthogonal axis is obviated by the vee-shape of the table, which constrains the movement of the values to a path along the working axis. Furthermore, because the compound cyclic motion is symmetric with respect to the up and down vertical motion and the to and fro rectilinear motion, it is not necessary to anchor the device to prevent it from moving along the ground during operation. Consequently, the combination of the compound cyclic motion, the vee-table, and the tilt-means results in a gravimetric mineral processing device that overcomes many of the most serious problems that plague analogous devices presently known.

Table-Drive Means and Legs

The embodiment of my invention disclosed above employs a table-drive means indirectly coupled to the table by drive-legs in order to transmit the compound cyclic motion to the table. My preferred embodiment employs two sets of two legs: two reciprocating aft legs 103 and two reciprocating fore legs 102 where the aft legs are the drive legs and the fore legs move passively. Of course, the choice of which leg or legs serve as drive-legs is somewhat arbitrary and may vary according to design considerations. It is also to be understood that the scope of my invention includes any number or arrangement of legs or other structural elements that transmit the compound cyclic motion produced by the table drive means to the table. For instance, the linkage assembly of the table-drive means may be coupled directly to the table. Alternatively, the table-drive means may include an appendage of the table that the linkage assembly connects to rather than to drive legs.

Control Elements and On-the-Fly Adjustments

One consideration that is to be given in choosing the stroke-adjustment means and tilt-means is whether the chosen mechanisms can be easily adjusted while the device is in operation, which is to say on-the-fly. The use of hydraulic cylinder/piston mechanisms as disclosed above is consistent with this goal. However, there are many equivalent mechanisms suitable for use as the stroke-adjustment means and/or the tilt-means. Such equivalent mechanisms include, by way of example, electric motors, hydraulic motors, and magnetic solenoids connected to worm drives, gear drives, levers, and the like. The motor used to power the table-drive means as disclosed above, is preferably also amenable to adjustments on-the-fly. Furthermore, the rate of flow of the processing-fluid through the manifold, as described above, preferably can be adjusted on-the-fly. Thus, while the foregoing FIG. 7 and its accompanying disclosure of my method for using my invention are simplified for didactic purposes, the operation of the device may be considerably more dynamic than what is indicated because there are multiple parameters that can be continuously controlled to give optimum results. Such control over these parameters can be exerted manually or by computer.

D. Summary

The invention may be summarized, at least in part, by the following enumerated statements:

Statement 1. A device for separating values in a feedstock from gangue in the feedstock, wherein said device has a values-end and an opposing gangue-end, said device comprising: a table, wherein said table is configured to receive and to hold said feedstock; a fluidizing means for fluidizing said feedstock to produce a fluidized feedstock, wherein said fluidized feedstock is held by said table; a chassis, wherein said chassis supports said table; and, a table-drive means for imparting a compound cyclic motion to said fluidized feedstock held by said table.

Statement 2. The device of Statement 1 wherein said table-drive means comprises: a drive-motor; an eccentric-coupler attached to said drive-motor, wherein said eccentric-coupler is rotated by said drive-motor; one or more reciprocating legs, wherein said reciprocating legs connect said table to said chassis, and wherein said reciprocating legs comprise a plurality of joints that allow said table to move in said compound cyclic motion; and, a linkage-assembly that couples said eccentric-coupler directly or indirectly to said table, whereby rotation of said eccentric-coupler by said drive-motor causes said compound cyclic motion to be imparted to said fluidized feedstock held by said table.

Statement 3. The device of Statement 2 wherein said table is a vee-table.

Statement 4. The device of Statement 2 further comprising a tilt-means for imparting a tilt-angle to said table.

Statement 5. The device of Statement 4 wherein said tilt-means comprises: a lift mechanism that lifts one end of said table; and a tilt-hinge at an opposing end of said table.

Statement 6. The device of Statement 5 wherein said lift mechanism comprises a hydraulic system.

Statement 7. The device of Statement 2 further comprising a values outlet in said table at or near said values end.

Statement 8. The device of Statement 2 wherein said linkage assembly means comprises: a leg-coupler connected to at least one of said reciprocating legs; and, a linkage-rod having a first end and a second end, wherein said first end of said linkage-rod is coupled to said eccentric-coupler, and wherein said second end of said linkage-rod is coupled to said leg-coupler.

Statement 9. The device of Statement 8 wherein said leg-coupler is a sliding-coupler configured to adjustably slide up and down said reciprocating leg, whereby a drive-stroke of said device is adjusted by varying a position of said sliding-coupler on said reciprocating leg.

Statement 10. The device of Statement 9 further comprising a stroke-adjustment means for adjusting the drive-stroke.

Statement 11. The device of Statement 2 wherein said fluidizing means comprises a manifold.

Statement 12. The device of Statement 2 further comprising on-the-fly control elements that control at least one of tilt-angle, drive-stroke, and motor speed on-the-fly.

Statement 13. The device of Statement 1 wherein said table is a vee-table.

Statement 14. The device of Statement 13 further comprising a tilt-means for imparting a tilt-angle to said vee-table.

Statement 15. The device of Statement 1 further comprising a tilt-means for imparting a tilt-angle to said table.

Statement 16. The device of Statement 15 wherein said tilt-means comprises: a lift mechanism that lifts one end of said table; and, a tilt-hinge at an opposing end of said table.

Statement 17. The device of Statement 1 further comprising a values outlet in said table at or near said values end.

Statement 18. The device of Statement 1 wherein said fluidizing means comprises a manifold.

Statement 19. A method of using the device of Statement 1, said method comprising the steps of: loading the feedstock into or onto said table; fluidizing the feedstock; applying power to said table-drive means; and, collecting the values.

Statement 20. The method of Statement 19, further comprising the step of: on-the-fly adjusting of at least one of: a tilt-angle of said table; a drive-stroke of said table-drive means; and, a drive speed of said table-drive means.

The invention claimed is:

1. A device for separating values in a feedstock from gangue in the feedstock, wherein said device has a values-end and an opposing gangue-end, said device comprising:

a. a vee-table, wherein said vee-table is configured to receive and to hold said feedstock;

b. a fluidizing means for fluidizing said feedstock to produce a fluidized feedstock, wherein said fluidized feedstock is held by said vee-table;

c. a chassis, wherein said chassis supports said vee-table; and, d. a table-drive means for imparting a compound cyclic motion to said fluidized feedstock held by said vee-table.

2. The device of claim 1 further comprising a tilt-means for imparting a tilt-angle to said vee-table.

3. The device of claim 2 wherein said tilt-means comprises:

a. a lift mechanism that lifts one end of said vee-table; and b. a tilt-hinge at an opposing end of said vee-table.

4. The device of claim 3 wherein said lift mechanism comprises a hydraulic system.

5. The device of claim 1 further comprising a values outlet in said vee-table at or near the values end.

6. The device of claim 1 wherein said fluidizing means comprises a manifold.

7. The device of claim 1 further comprising on-the-fly control elements that control at least one of tilt-angle, drive-stroke, and motor speed.

8. A method of using the device of claim 1, said method comprising the steps of:

(a) loading the feedstock into or onto said vee-table;

(b) fluidizing the feedstock;

(c) applying power to said table-drive means; and, (d) collecting the values.

9. The method of claim 8, further comprising the step of:

(e) on-the-fly adjusting of at least one of:

i. a tilt-angle of said vee-table;

ii. a drive-stroke of said table-drive means; and, iii. a drive speed of said table-drive means.

10. The device of claim 1 wherein said table-drive means comprises:

a. a drive-motor;

b. an eccentric-coupler attached to said drive-motor, wherein said eccentric-coupler is rotated by said drive-motor;

c. one or more reciprocating legs, wherein said reciprocating legs connect said vee-table to said chassis, and wherein said reciprocating legs comprise a plurality of joints that allow said vee-table to move in said compound cyclic motion; and, d. a linkage-assembly that couples said eccentric-coupler directly or indirectly to said vee-table, whereby rotation of said eccentric-coupler by said drive-motor causes said compound cyclic motion to be imparted to said fluidized feedstock held by said vee-table.

11. The device of claim 10 further comprising a tilt-means for imparting a tilt-angle to said vee-table.

12. The device of claim 11 wherein said tilt-means comprises:

a. a lift mechanism that lifts one end of said vee-table; and, b. a tilt-hinge at an opposing end of said vee-table.

13. The device of claim 10 further comprising a values outlet in said vee-table at or near said values end.

14. The device of claim 10 wherein said fluidizing means comprises a manifold.

15. The device of claim 10 wherein said linkage assembly comprises:

a. a leg-coupler connected to at least one of said reciprocating legs; and, b. a linkage-rod having a first end and a second end, wherein said first end of said linkage-rod is coupled to said eccentric-coupler, and wherein said second end of said linkage-rod is coupled to said leg-coupler.

16. The device of claim 15 wherein said leg-coupler is a sliding-coupler configured to adjustably slide up and down said reciprocating leg, whereby a drive-stroke of said device is adjusted by varying a position of said sliding-coupler on said reciprocating leg.

17. A method for using a device for separating values in a feedstock from gangue in the feedstock, wherein the device has (1) a values-end; (2) an opposing gangue-end; (3) a table, wherein the table is configured to receive and to hold the feedstock; (4) a fluidizing means for fluidizing the feedstock to produce a fluidized feedstock, wherein the fluidized feedstock is held by the table; (5) a chassis, wherein the chassis supports the table; and (6) a table-drive means for imparting a compound cyclic motion to the fluidized feedstock held by the table, said method comprising the steps of:

(a) loading the feedstock into or onto the table;

(b) fluidizing the feedstock;

(c) applying power to the table-drive means; and, (d) collecting the values.

18. The method of claim 17, further comprising the step of:

(e) on-the-fly adjusting of at least one of:

i. a tilt-angle of the table;

ii. a drive-stroke of the table-drive means; and, iii. a drive speed of the table-drive means.

* * * * *